US011959711B1

(12) United States Patent
Dindl et al.

(10) Patent No.: US 11,959,711 B1
(45) Date of Patent: Apr. 16, 2024

(54) RECOILLESS GUN AND AMMUNITION

(71) Applicant: U.S. Government as Represented by the Secretary of the Army, Dover, NJ (US)

(72) Inventors: Frank Dindl, Byram, IN (US); Kenneth Jones, Wayne, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/965,446

(22) Filed: Oct. 13, 2022

Related U.S. Application Data

(60) Provisional application No. 63/256,070, filed on Oct. 15, 2021.

(51) Int. Cl.
*F41A 1/10* (2006.01)

(52) U.S. Cl.
CPC ..... *F41A 1/10* (2013.01)

(58) Field of Classification Search
CPC ..... F41A 1/08; F41A 1/10
See application file for complete search history.

(56) References Cited

U.S. PATENT DOCUMENTS 1,108,717 A * 8/1914 Davis ..... F42B 5/02 89/1.701
1,280,579 A * 10/1918 Stone et al. ..... F41A 1/10 89/1.7
1,446,000 A 11/1920 Davis
1,395,630 A 11/1921 Davis
2,156,605 A * 5/1939 Prettyman ..... F41A 1/10 89/1.701
2,791,961 A * 5/1957 Walton ..... F41A 1/08 89/1.704
2,798,413 A * 7/1957 Fowler ..... F41A 3/28 89/14.05
3,228,337 A * 1/1966 Grantham ..... H04B 10/00 102/221
3,563,177 A * 2/1971 Ritchey ..... F41A 19/58 102/431
3,685,392 A * 8/1972 Platt ..... F41A 19/58 42/76.01
3,745,876 A * 7/1973 Rocha ..... F41F 3/077 89/1.816
3,771,417 A * 11/1973 Schnabele ..... F41A 1/08 89/14.6
4,050,351 A * 9/1977 Stauff ..... F41A 1/10 89/1.701
4,132,148 A * 1/1979 Meistring ..... F41A 1/10 89/14.6
4,406,209 A * 9/1983 Arene ..... F41A 1/10 89/1.14
4,452,123 A * 6/1984 Holtrop ..... F42B 5/26 89/33.03

(Continued)

*Primary Examiner* — Derrick R Morgan
(74) *Attorney, Agent, or Firm* — John P. DiScala

(57) ABSTRACT

A recoilless gun system, comprising a gun assembly and associated ammunition for use with the gun assembly employs an integral barrel and a rear inserted ammunition round. The recoilless gun system may combine a laser initiator and a polymer cased ammunition to enable a lightweight system. In such embodiments, the cartridge case is made from a polymer that resists high pressure before extruding into small gaps.

16 Claims, 8 Drawing Sheets

(56) References Cited

U.S. PATENT DOCUMENTS

| | | | | | |
|---|---|---|---|---|---|
| 4,593,602 | A * | 6/1986 | Faix | F41A 19/27 | 89/27.13 |
| 4,643,071 | A * | 2/1987 | Baechler | F41A 1/10 | 89/1.701 |
| 4,843,946 | A * | 7/1989 | Gladstone | F41A 21/02 | 89/1.7 |
| 4,917,014 | A * | 4/1990 | Loughry | F42B 3/113 | 102/201 |
| 5,179,246 | A * | 1/1993 | Betts | F42B 3/113 | 102/202 |
| 5,301,448 | A * | 4/1994 | Petrick | F42B 5/16 | 42/84 |
| 5,357,841 | A * | 10/1994 | Clark | F41A 1/08 | 89/1.703 |
| 6,286,408 | B1 * | 9/2001 | Sanford | F41A 1/08 | 89/1.7 |
| 6,722,283 | B1 | 4/2004 | Dindl | | |
| 6,904,838 | B1 | 6/2005 | Dindl | | |
| 7,089,863 | B1 | 8/2006 | Dindl | | |
| 7,207,276 | B1 | 4/2007 | Dindl | | |
| 7,350,449 | B2 * | 4/2008 | Franzen | F41A 1/10 | 42/1.06 |
| 7,418,896 | B1 | 9/2008 | Dindl | | |
| 7,624,668 | B1 * | 12/2009 | Sanford | F41A 1/08 | 89/1.701 |
| 7,886,649 | B2 * | 2/2011 | Pettersson | F41A 11/02 | 89/1.701 |
| 10,488,127 | B2 | 11/2019 | Jezierski | | |
| 11,536,551 | B1 * | 12/2022 | Redington | H01S 5/0233 | |
| 2007/0256552 | A1 * | 11/2007 | Regebro | F41A 1/10 | 89/1.7 |

* cited by examiner

RECOILLESS GUN AND AMMUNITION

CROSS-REFERENCE TO RELATED APPLICATIONS

This application claims the benefit under 35 USC § 119(e) of U.S. provisional patent application 63/256,070 filed on Oct. 15, 2021.

STATEMENT OF GOVERNMENT INTEREST

The inventions described herein may be manufactured, used and licensed by or for the United States Government.

FIELD OF THE INVENTION

The invention relates in general to weapons and in particular to recoilless weapons.

BACKGROUND OF THE INVENTION

Recoilless guns provide a means for cancelling the recoil from the firing weapon. One approach accomplishes this by launching a countermass out of the rear of the weapon thereby counteracting the recoil from launching a projectile out the front of the weapon. For example, the Davis gun is one example of a recoilless gun which employs this approach.

Existing recoilless guns typically include a barrel that breaks open to allow the loading of an ammunition cartridge. This joint presents a design challenge. Further, it produces a weapon that is more complex and difficult to manufacture. Finally, the joint causes prior designs to be heavier at a detriment to the user.

A need exists for a recoilless weapon which does not require a barrel that breaks open to allow a cartridge to be loaded.

SUMMARY OF INVENTION

One aspect of the invention is a recoilless gun system comprising a grin assembly and an ammunition round. The gun assembly further comprises an integral barrel and an initiator. The integral barrel has a forward muzzle and a rear muzzle. The initiator is mounted on the integral barrel and provides an initiation stimulus to a primer contained within the integral barrel. The ammunition round further comprises a cartridge case, a primer, propellant, ballast, and a payload. The cartridge case includes a front cavity housing a propellant and a payload and a rear cavity housing a ballast mass. The primer charge is situated between the front cavity and the rear cavity. The primer charge is ignited by the initiation device to initiate the payload propellant. The ammunition round is inserted in the rear muzzle of the integral barrel. The primer charge is ignited by the initiator and the rear cavity of the ammunition cartridge is of sufficient length to allow the ballast mass to counteract the force of the ejecting payload.

Another aspect of the invention is a recoilless gun system which comprises a gun assembly and an ammunition cartridge. The gun assembly further comprises an integral barrel and a laser initiator. The barrel has a front muzzle and a rear muzzle. The laser initiator is mounted to the exterior of the barrel such that a laser light from the laser travels through an opening defined by the barrel and extending from the exterior surface into an interior cavity of the barrel. The ammunition cartridge further comprises a polymer cartridge ease comprising a front cavity and a rear cavity, said front cavity housing a laser ignitable primer, propellant, and a payload and said rear cavity comprising a ballast mass. The ammunition cartridge is inserted into the rear of the barrel, said laser ignitable primer is initiated by the laser light through the polymer cartridge case and the rear cavity of the ammunition cartridge is of sufficient length to allow the ballast mass to counteract the force of the ejecting payload. The ballast mass may be heavier than the projectile to reduce the bore travel required by the ballast mass, reducing the overall length of the barrel and cartridge case.

Another aspect of the invention is a recoilless gun system which comprises a gun assembly and a medium caliber ammunition round. The gun assembly further comprises a two-piece medium caliber barrel and a laser initiator. The two-piece medium caliber barrel has a forward muzzle and a rear muzzle and the two-pieces are separable during travel. The laser initiator is mounted on the integral barrel proximate a hole extending through the barrel such that the output of the laser initiator is communicable to a cartridge case located within the interior of the barrel. The medium caliber ammunition round further comprises a polymer cartridge case, a propellant, a payload, a ballast mass and a primer charge. The polymer cartridge case comprises a front cavity which houses a propellant and a payload and a rear cavity which houses a ballast mass. The primer charge is situated between the front cavity and the rear cavity and is ignited by the initiation device to initiate the propellant. The weight of the ballast is approximately five times greater than the weight of payload and a bore travel of the payload is approximately five times greater than a bore travel of the ballast.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

The recoilless gun system described herein, comprises a gun and associated ammunition for use with the gun. The gun includes an integral barrel and the ammunition is configured to be inserted into the barrel from the rear thereby eliminating any gap in the barrel. The use of an integral barrel increases simplicity and reliability of the design and reduces the weight of the overall system. Further, by employing a rear loading scheme, the recoilless gun system is also simple to operate and easily reloadable.

The recoilless gun may be adapted for use in a variety of applications, such as mounted on a vehicle or carried by an individual user, and with a variety of ammunition types and sizes. In one embodiment, the recoilless gun system is particularly suited for use on a small unmanned aerial system (VAS) due to its low relative weight. Further, when employing ammunition with a shot payload and mounted on a UAS, the recoilless gun system provides a counter-UAS solution or effective anti-personnel solution. In another embodiment, the recoilless gun system may be sized to fire 40 mm ammunition, mounted or unmounted. In other embodiments, the recoilless gun is sized to function as a high velocity, low recoil shoulder fired 40 mm grenade launcher. In yet another embodiment, the recoilless gun is adapted for use as a shoulder fired 25 mm weapon with performance similar to that of the 25 mm M242 employed by the United States Army.

Figure 1:
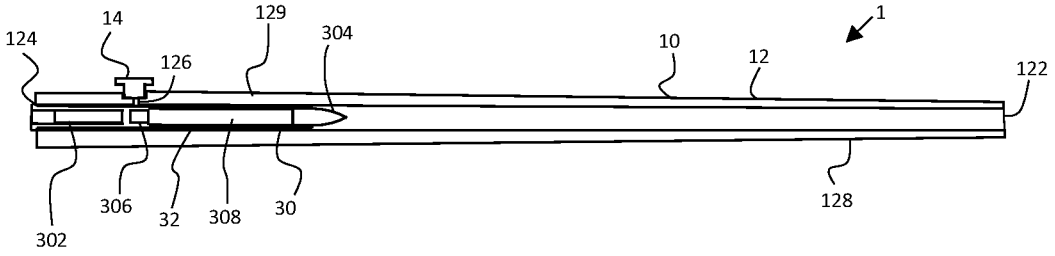
FIG. 1 is a sectional plan view of the recoilless gun system with a single projectile, according to an illustrative embodiment.
Figure 2:
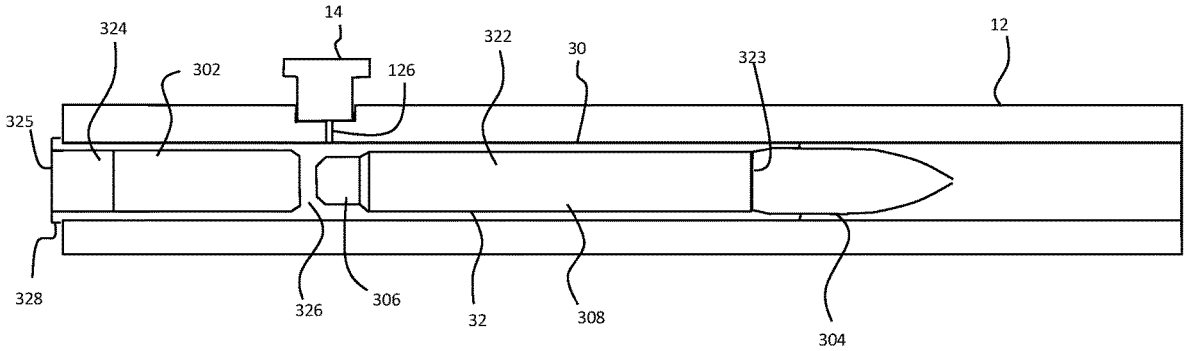
FIG. 2 is a close up view of the breech end of the recoilless gun system of FIG. 2, according to an illustrative embodiment.

FIG. 1 is a sectional plan view of the recoilless gun system with a single projectile, according to an illustrative embodiment. FIG. 2 is a close up view of the breech end of the recoilless gun system of FIG. 1, according to an illustrative embodiment.

The recoilless gun system 1 comprises a gun assembly 10 and an ammunition round 30. The ammunition round 3C) is inserted into and fired from the gun assembly 10. A ballast 302 contained in the ammunition round 30 is concurrently ejected from the rear of the barrel 12 to cancel the recoil from the ammunition payload 304.

The gun assembly 10 further comprises a barrel 12 and an initiation device 14. The barrel 12 is integral and has both a front muzzle 122 and a rear muzzle 124. In embodiments, the barrel 12 is generally tubular with a tubular interior volume open at front muzzle 122 and rear muzzle 124. The barrel 12 further defines a hole 126 extending from the exterior surface of the barrel 12 to the interior surface of the barrel 12 thereby allowing the initiation device 14 to communicate with the interior volume. As will be described in more detail, the hole 126 is sized and dimensioned to allow an initiation stimulus to be communicated to the interior of the barrel 12 without affecting the operation of the ammunition round 30.

In an embodiment, both a front portion 128 of the barrel 12 and a rear portion 129 of the interior surface of the barrel 12 are rifled. The front portion 128 extends at least from approximately the front end of the ammunition round 30 to the front muzzle 122 and serves to impart spin on the payload 304. The rear portion 129 extends approximately from the front end of the ammunition cartridge to the rear muzzle 124. The rear rifling is larger in diameter than the payload 304 and cartridge case 32 to allow for ease of loading the ammunition round 30. The cartridge case expands during firing to engage the rear rifling. The rear rifling imparts a spin on the ballast 302 and cartridge case 32 thereby ensuring that the ballast 302 spreads open and rapidly decelerates due to aerodynamic forces.

The initiation device 14 is positioned on the exterior of the barrel 12 and provides an initiation stimulus to the interior of the barrel 12 to initiate a primer charge 306 in the ammunition round 30. In one embodiment, the initiation device 14 is a laser initiator 14, such as a laser diode 14, which projects a laser beam through the hole 126 in the barrel 12 and into the interior of the barrel 12. A laser initiator 14 is particularly suited for remotely operated recoilless gun systems. As will be described in more detail below, laser initiation in combination with a polymer ammunition round 30 provides a simple, robust and reliable means for firing the ammunition round 30. Laser initiation minimizes the action time between when the command to fire is given and projectile exit, increasing system accuracy compared to percussion primed ammunition systems.

Embodiments with percussion initiation may be preferred for alternate applications. In these embodiments, the percussion initiator provides a percussive stimulus to the interior of the barrel 12. For example, the percussion initiator may comprise a firing pin mechanism in which a firing pin is directed to the interior of the barrel 12 with sufficient force to initiate a primer charge 306. In embodiments with a percussion initiator, a primer charge 306 may be mounted on the side of the cartridge case 32. The cartridge case 32 and barrel 12 may have corresponding indexing features that ensure that the primer charge 306 is aligned with the firing pin.

The ammunition round 30 further comprises a cartridge ease 32, primer charge 306, propellant 308, payload 304 and ballast 302. In the embodiment shown, a relatively long cartridge case 32 is sized and dimensioned to be inserted into the rear muzzle 124 of the barrel 12. The cartridge case is relatively long, typically twice the length of an equivalent performance closed breech ammunition of the same caliber, as it houses the ballast. In addition, the propellant charge is larger than for an equivalent performance closed breech ammunition. Finally, the ease diameter is limited to about the size of the projectile so that the ammunition round may be inserted through the rear of the barrel.

Once inserted into the rear of the barrel 12, the primer charge 306 is aligned with the initiation device 14 such that the initiation device 14 may initiate the primer charge 306 which in turn initiates the propellant 308 to propel the payload 304 from the front muzzle 122, the ballast 302 from the rear muzzle 124 and in embodiments, the frangible cartridge case 32 from the rear muzzle 124 and/or front muzzle 122.

A ballast 302 is ejected from the rear muzzle 124 to counteract the recoil force of the payload 304. The cartridge case 32 positions the payload 304, propellant 308, and ballast 302 sufficiently far from the rear muzzle 124 to provide sufficient bore travel for the ballast 302 such that the ballast 302 exits the rear muzzle 124 at nearly the same time as the payload 304 exits the front muzzle 122 to optimize interior ballistic efficiency. Loading the weapon from the rear muzzle 124 makes reloading extremely simple.

The ammunition round 30 comprises a cartridge case 32 which is generally cylindrical and defines a front cavity 322 and a rear cavity 324 separated by a center wall 326. Both the front cavity 322 and rear cavity 324 have openings 323,325. The front cavity 322 houses a primer charge 306 to the rear of the front cavity 322 adjacent to the center wall 326. A payload 304 sits in the front cavity 322. In the embodiment shown in which the payload 304 is a bullet projectile 304, the bullet projectile 304 is partially housed within the front cavity 322, extending beyond the mouth of the case 32, and encloses the front cavity 322. The remainder of the front cavity 322 is filled by propellant 308.

The ballast 302 is housed at the front of the rear cavity 324 adjacent to the center wall 326. The remaining rear cavity 324 provides a path for the ballast 302 to travel.

In one embodiment, the cartridge case 32 comprises a lip 328 extending around the external diameter of the cartridge case 32 which prevents the cartridge case 32 from being inserted into the barrel 12 past the lip 328. The lip diameter is greater than the internal diameter of the barrel 12.

In one embodiment, the cartridge case 32 is made of polymer. More specifically, the cartridge case 32 is made from a polymer which resists high pressure before extruding into small gaps, such as Radel® PPSU polyphenylsulfone available from Solvay SA.

Embodiments in which the cartridge case 32 is made from polymer are particularly suited for laser initiation of the primer charge 306. In the embodiment shown in FIGS. 1 and 2, a laser diode 14 is mounted to the exterior of the gun barrel 12. The laser diode 14 is preferably mounted perpendicular or nearly so to the centerline of the barrel 12, and the laser light passes through the hole 126 in the barrel 12 and then passes through the wall of the polymer ammunition cartridge case 32 to heat the primer charge 306 to the ignition temperature. Advantageously, the ammunition round 30 can be inserted in any radial orientation as the laser initiator 14 does not require a certain radial alignment of the primer charge 306.

Identifying a polymer with sufficient material properties for use in the cartridge case 32, and limiting the size (diameter) of the hole 126 in the barrel wall to less than about inches prevents the polymer case material from extruding into the laser hole 126. PPSU is one such polymer, where the polymer requires very high pressures to extrude into small gaps. A inch diameter hole 126 is more than sufficient for the laser energy to pass through, yet small enough to prevent the polymer case material from extruding in to the hole 126.

Figure 3:
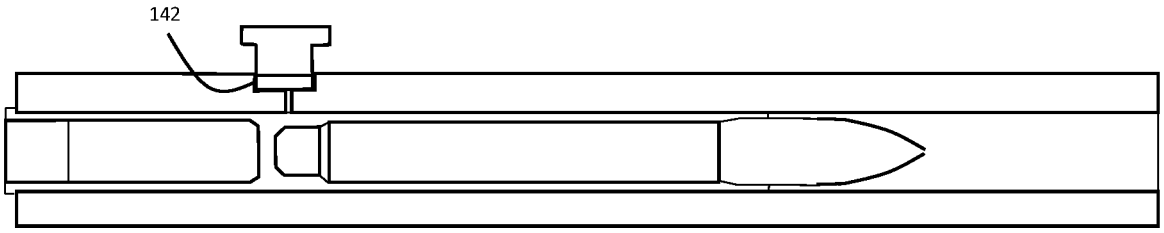
FIG. 3 is a sectional plan view of the recoilless gun system with a protective disk, according to an illustrative embodiment.

FIG. 3 is a sectional plan view of the recoilless gun system with a protective disk, according to an illustrative embodiment. In an embodiment, the recoilless gun system 1 further comprises a protective disk 142 positioned between the laser diode 14 and the gun barrel 12 to protect the laser diode 14 from propellant gases escaping through the opening in the gun barrel 12. The protective disk 142 is made from a material which allows the laser light to pass through but does not allow the propellant gases to pass through. For example, in an embodiment the protective disk 142 is made from sapphire.

The payload 304 is propelled by the propellant 308 out of the barrel 12. In the embodiment shown, the payload 304 is a projectile 304 and more specifically, a bullet projectile 304. However, the payload 304 is not limited to bullets and may comprise any projectile which can be propelled from a barrel 12. For example, in alternate embodiments, the payload 304 may be a shot payload. In still other embodiments, the payload 304 may be a 40 millimeter grenade.

The recoilless gun system 1 employs a significantly heavier ballast 302 than the projectile 304 thereby allowing for a rear barrel 12 of the gun, or bore travel associated with the ballast 302, to be significantly shorter than the barrel 12 used to launch the projectile 304 thereby reducing the overall length of the weapon. The combination of the ballast mass and ease mass require bore travel that is proportional to the bullet bore travel.

For example, the cartridge case 32 may contain a powder ballast 302.

In embodiments of the invention, the rear portion of the barrel 12 is rifled thereby imparting spin to the ballast 302 and ensuring that the ballast 302 spreads open and rapidly decelerates due to aerodynamic forces.

Figure 4:
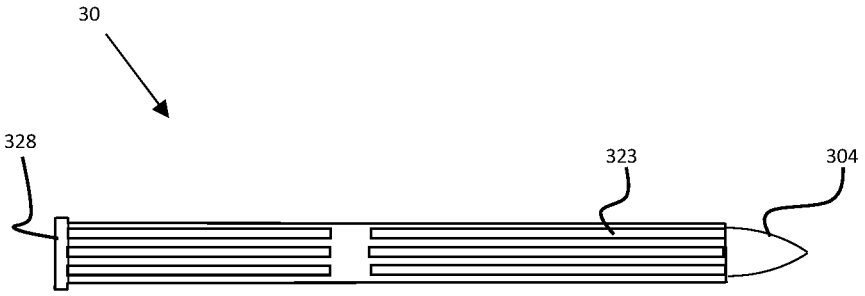
FIG. 4 shows an ammunition round with a frangible cartridge case, according to an embodiment of the invention.

FIG. 4 shows an ammunition round with a frangible cartridge case, according to an embodiment of the invention. An embodiment of the system 1 employs an ammunition round 30 with a polymer cartridge case 32, where the cartridge case 32 is ejected out the rear muzzle 124 and/or front muzzle 122 of the barrel 12 along with the ballast 302 and/or payload 304, respectively. Additionally, the forward portion and/or rear portion of the cartridge case 32 exterior surface may have scores 323 or be otherwise rendered frangible such that it breaks up to aid exhaustion out of the rear muzzle 124 and/or front muzzle 122. The frangible portion of the case 32 exhausts out of the end of the barrel 12 in which its respective projectile, i.e. the payload 304 or the ballast 302, exits first.

Figure 5:
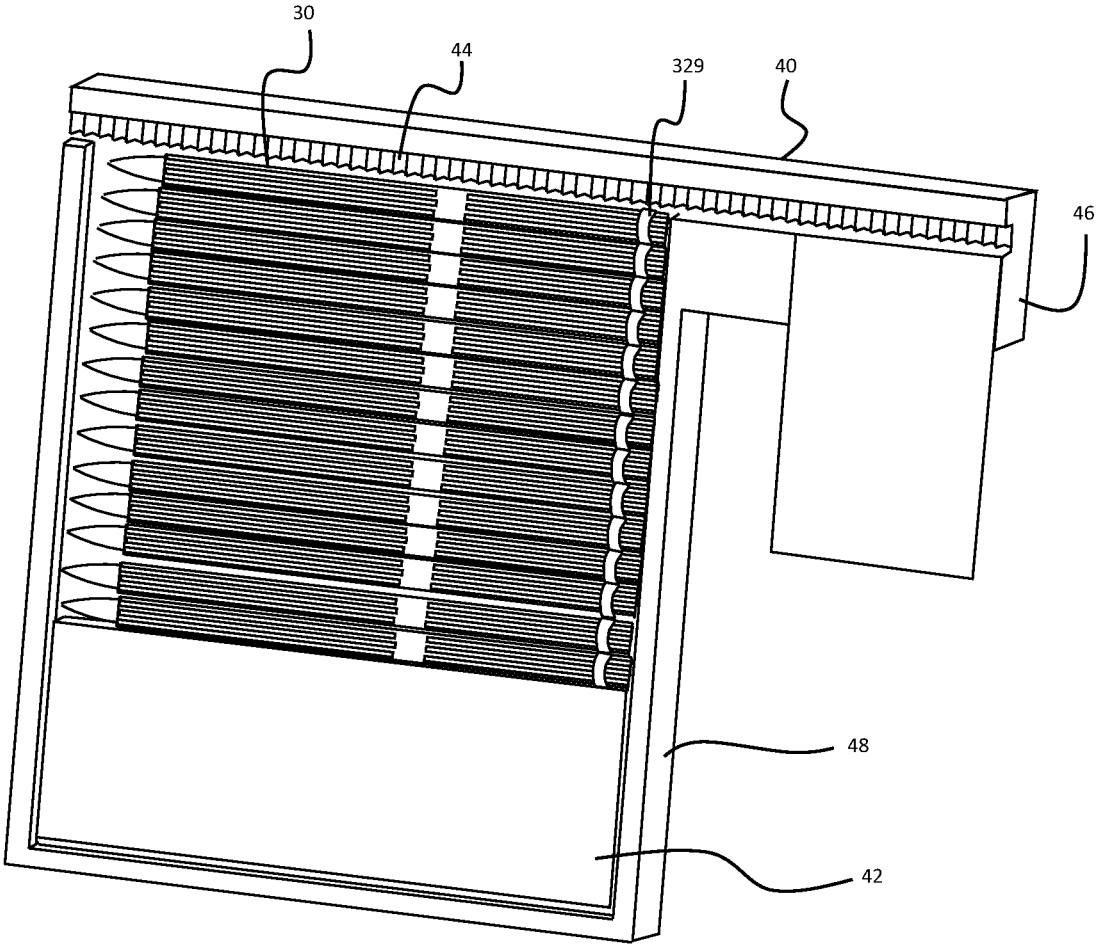
FIG. 5 is a sectional plan view of an autoloader for a recoilless gun system, according to an illustrative embodiment.

FIG. 5 is a sectional plan view of an autoloader for the recoilless gun system, according to an illustrative embodiment. In one embodiment, the cartridge case 32 has a maximum diameter that is the same, or slightly smaller, than the projectile 304, except for a ridge 329 near the rear end of the cartridge case 32 thereby allowing the ammunition round 30 to be easily chambered. The small ridge 329 provides an interference fit that prevents the cartridge case 32 from moving once inserted into the barrel 12. Keeping the cartridge case diameter the same or nearly the same as the projectile diameter makes it easier to feed from a magazine. Magazine use enables the use of an autoloader 40 in the recoilless gun system 1.

The autoloader 40 comprises a straight magazine 42 with a motor driven plunger 44 that pushes the top ammunition round out of the magazine and into the rear of the recoilless gun barrel 12. The magazine holds one or more ammunition rounds 30 stacked on top of each other. A rack and pinion plunger is positioned at the top of the magazine for feeding the upward-most ammunition round 30 into the barrel 12. The rack and pinion plunger is driven by a motor disposed to the rear of the magazine. An upwardly biased follower exerts an upward force on the ammunition rounds 30 within the magazine.

Figure 6:
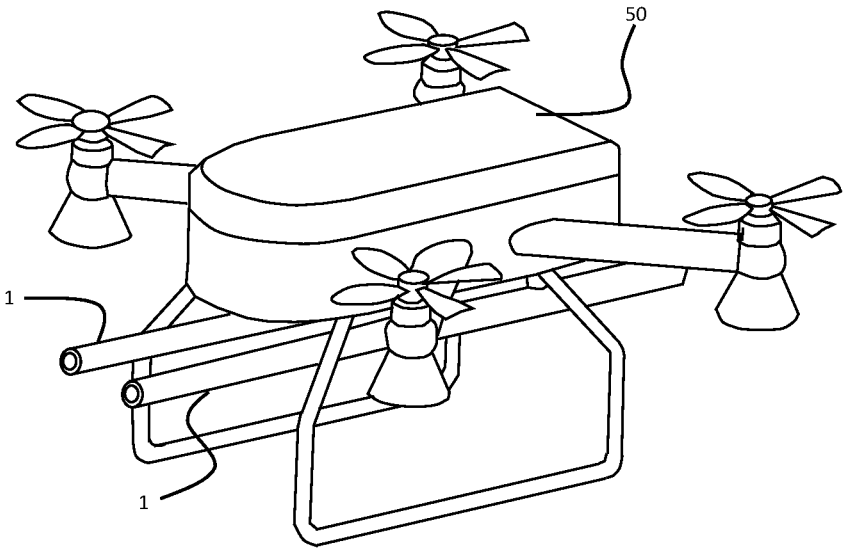
FIG. 6 is an illustration of an unmanned aerial system (UAS) with two recoilless gun systems mounted on a body of the UAS, according to an illustrative embodiment.

FIG. 6 is an illustration of an unmanned aerial system WAS) with two recoilless gun systems mounted on a body of the UAS, according to an illustrative embodiment. The recoilless gun system 1 may be configured for use on an UAS. In one such an application, the recoilless gun system 1 may be configured in a lightweight configuration to enable transportation by a relatively small UAS, such as a Group 1 or Group 2 UAS.

In one example embodiment in which a recoilless gun system 1 with a shot payload 346 is employed on a UAS, the weight of the loaded weapon is less than four (4) ounces (oz.). To achieve this weight, the gun barrel 12 interior diameter is approximately five and seven tenths (5.7) millimeters (mm) in diameter, twelve (12) inches (in.) in length and composed of steel. Laser initiation is provided by a five (5) watt eight hundred (800) to one thousand (1000) nanometer (nm.) wavelength. The laser diode 14 is mounted proximate a 0.02 inch diameter hole 126 in the barrel 12. The cartridge case 32 is approximately five (5) inches (in.) in length and composed of PPSU. The cartridge case. 32 comprises a shot payload 346 thereby providing an effective counter-UAS or anti-personnel solution. The ballast 302 comprises one hundred eighty (180) grains of tungsten powder. Tungsten powder is sized between ten (10) and one hundred (100) microns to minimize the potential for inhalation and eye hazards.

Figure 7:
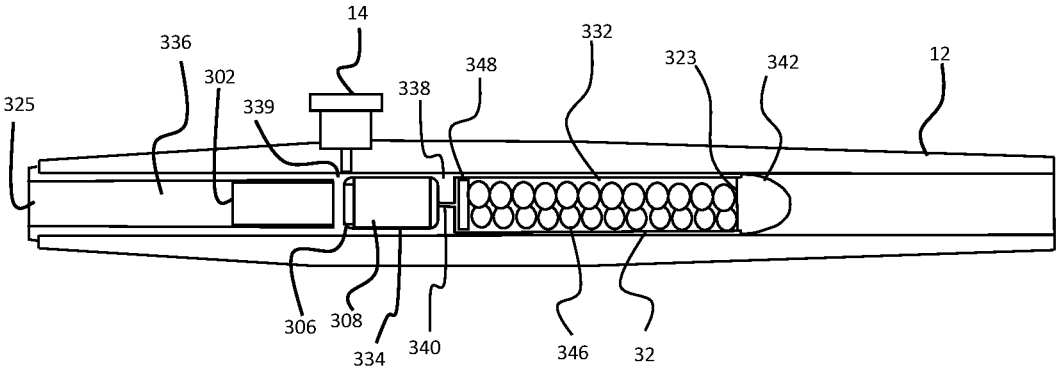
FIG. 7 is a sectional plan view of the recoilless gun system with a shot payload, according to an illustrative embodiment.

FIG. 7 is a sectional plan view of the recoilless gun system with a shot payload, according to an illustrative embodiment. The ammunition comprises a shot payload 346, a pusher 348, a propellant 308, a primer charge 306, a stopper and a ballast 302. The cartridge case 32 comprises a front interior volume 332, a rear interior volume 336 and an intermediate interior volume 334 situated between the two. The front interior volume has an opening in its front end 323 which is enclosed by a stopper 342 which is ogive shaped. The rear interior volume has an opening 325 at its rear end. The intermediate volume is separated from each of the front and rear interior volumes by walls 338, 339, with the wall 338 between the front interior volume and the intermediate volume having a channel 340 connecting the two. The primer charge 306 and propellant 308 are contained within the intermediate volume. The pusher and shot payload 346 are contained in the front volume, separated from the primer charge 306 and propellant 308.

In operation, the primer charge 306 is initiated by the laser initiator 14 which in turn initiates the propellant 308. The expanding propellant gases communicate with the stopper through the channel. The stopper is propelled forward which in turn propels the shot payload 346 forward until the stopper is removed from the front interior volume. The stopper and shot payload 346 are ejected out of the barrel 12. Concurrently, the expanding propellant gases propel the ballast 302 rearward and out of the rear of the barrel 12.

In another example embodiment in which the recoilless gun system 1 is mounted on a UAS, the gun system 1 is configured to fire forty (40) millimeter (mm) ammunition. In a high velocity configuration the recoilless gun system 1 is three and two tenths (3.2) pounds (lbs.) when loaded. In a low velocity configuration, the recoilless gun system 1 is one and six tenths (1.0 lbs. when loaded. The high velocity configuration differs from the low velocity configuration in the amount of propellant used, peak chamber pressure and strength of the barrels.

Figure 8:
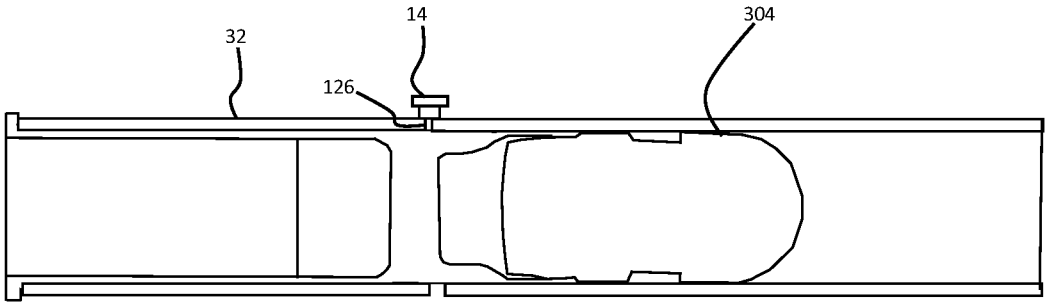
FIG. 8 is a sectional plan view of a recoilless gun system configured as a grenade launcher system, according to an illustrative embodiment.

FIG. 8 is a sectional plan view of a recoilless gun system configured as a grenade launcher system, according to an illustrative embodiment. In other embodiments, the recoilless gun is sized to function as a high velocity, low recoil shoulder fired forty (40) ram grenade launcher. In one example of such an embodiment, the recoilless gun is five (5) lbs. when loaded.

Laser initiation is provided by a laser diode 14 mounted proximate a two one thousandths (0.02) inch (in.) diameter hole 126 in the barrel 12. The cartridge case 32 is approximately twelve (12) in. in length and composed of PPSU. The cartridge ease 32 comprises a forty (40) mm grenade payload 304. The ballast 302 comprises eight (8) ounces (oz.) of ballast 302.

In yet another embodiment, the recoilless gun is adapted for use as a shoulder fired medium caliber weapon with performance similar to that of the twenty-five (25) millimeter (nm) M242 employed by the United States Army. In this context, medium caliber means approximately twenty (20) to twenty-five (25) mm caliber, in this embodiment, the recoilless gun weighs approximately thirty-eight (38) lbs. with a composite wrapped barrel 12 and operates at one hundred (100) kilograms per square inch (ksi) to reduce barrel length while still achieving desired muzzle velocities. The twenty-five (2.5) mm recoilless gun barrel is made in two-pieces, each forty-seven (47) in. long for a total of ninety-four (94) in. The forward portion of the barrel provides the bore travel of the projectile. The rear portion of the projectile provides for the cartridge case and roughly twelve (12) in. of bore travel for the ballast. The weapon transport length of this embodiment is less than forty-seven (47) in.

The twenty-five (25) mm projectile weighs one hundred (100) grams. The ballast 302 weighs five hundred (500) grams. This allows the bore travel for the ballast 302 to be one-fifth (⅕) the bore travel of the projectile. The projectile exits the front muzzle before the ballast exits the rear muzzle so that almost all of the propellant gases exit through the front muzzle, thereby significantly reducing back blast.

While the invention has been described with reference to certain embodiments, numerous changes, alterations and modifications to the described embodiments are possible without departing from the spirit and scope of the invention as defined in the appended claims, and equivalents thereof.

What is claimed is:

1. A recoilless gun system comprising:

a gun assembly further comprising:

an integral barrel having a forward muzzle and a rear muzzle, and an initiator mounted on said integral barrel for providing an initiation stimulus to a primer charge contained within the integral barrel;

an ammunition round further comprising a frangible cartridge case comprising a front cavity housing a propellant and a payload and a rear cavity housing a ballast mass, said cartridge case having an exterior surface defining a plurality of scored regions along a forward portion of the exterior surface, each of the scored regions extending longitudinally from a front of the cartridge surface and a plurality of scored regions along a rear portion of the exterior surface, each of the scored regions extending longitudinally from a back of the cartridge case;

the primer charge situated between said front cavity and rear cavity and ignited by the initiation device to initiate the payload propellant; and wherein to operate, the ammunition round is inserted in the rear muzzle of the integral barrel said primer charge is ignited by the initiator and the ballast mass is propelled out of the rear muzzle to counteract the force of the ejecting payload out of the forward muzzle and wherein the cartridge case is configured to break up and be propelled out of the forward muzzle and rear muzzle of the integral barrel with the ballast mass and the payload.

2. The recoilless gun system of claim 1 wherein the recoilless gun system is mounted on a UAV.

3. The recoilless gun system of claim 1 wherein the recoilless gun system is a 40 mm gun system and the ammunition round is a 40 mm grenade.

4. The recoilless gun system of claim 1 wherein the recoilless gun system is a shoulder fired gun and the ammunition round is a 25 mm round.

5. The recoilless gun system of claim 1 wherein the initiator is a laser initiator mounted on an exterior surface of the integral barrel and the integral barrel defines a hole extending through the barrel such that the output of the laser initiator is communicable to the interior of the barrel.

6. The recoilless gun system of claim 5 wherein the hole is less than or equal to inches.

7. The recoilless gun system of claim 6 wherein the cartridge case is made of polyphenylsulfone.

8. The recoilless gun system of claim 5 wherein the gun assembly further comprises a sapphire disc positioned between the interior of the barrel and the laser initiator.

9. The recoilless gun system of claim 1 wherein the initiator is a percussion initiator mounted on which provides a percussive force to the interior of the barrel and wherein the primer is positioned within the cartridge case to be initiated by the percussion initiator.

10. The recoilless gun system of claim 9 wherein the gun assembly and the ammunition round comprise corresponding indexing features such that the primer is aligned with the percussion initiator when the round is inserted into the barrel.

11. The recoilless gun system of claim 1 wherein a rear portion of the integral barrel further comprises rifling and the ballast mass is configured to spread as it rotates.

12. The recoilless gun system of claim 1 wherein a body of the cartridge case comprises a maximum diameter equal to or less than the diameter of a projectile payload and wherein the cartridge case further comprises a lip at the rear of the cartridge case having a diameter greater than the interior diameter of the barrel.

13. The recoilless gun system of claim 12 further comprising an autoloader magazine.

14. A recoilless gun system comprising:

a gun assembly further comprising an integral barrel having a forward muzzle and a rear muzzle, and a laser initiator mounted on said integral barrel proximate a hole extending through the barrel such that the output of the laser initiator is communicable to a cartridge case located within the interior of the barrel;

an ammunition round further comprising said cartridge case is a frangible polymer cartridge case comprising a front cavity housing a propellant and a payload and a rear cavity housing a ballast mass, said cartridge case having an exterior surface defining a plurality of scored regions along a forward portion of the exterior surface, each of the scored regions extending longitudinally from a front of the cartridge surface and a plurality of scored regions along a rear portion of the exterior surface, each of the scored regions extending longitudinally from a back of the cartridge case, a primer charge situated between said front cavity and rear cavity and ignited by the initiation device to initiate the propellant; and wherein the ammunition round is inserted in the rear muzzle of the integral barrel and said primer charge is ignited by the laser initiator and the ballast mass is propelled out of the rear muzzle to counteract the force of the ejecting payload out of the forward muzzle and wherein the cartridge case is configured to break up and be propelled out of the forward muzzle and rear muzzle of the integral barrel with the ballast mass and the payload.

15. The recoilless gun system of claim 14 wherein the payload is a shot payload.

16. The recoilless gun system of claim 14 wherein the ballast weighs five times the weight of the payload and a bore travel length of the payload is five times a bore travel length of the ballast.

* * * * *